United States Patent [19]

van Belzen et al.

[11] Patent Number: 4,534,331

[45] Date of Patent: Aug. 13, 1985

[54] CONTROL DEVICE FOR A FUEL METERING SYSTEM OF AN INTERNAL COMBUSTION ENGINE

[75] Inventors: David van Belzen, Hemmingen; Günter Hönig, Ditzingen; Gerhard Lotterbach; Jan-Faas van Woudenberg, both of Markgröningen; Udo Zucker, Güglingen, all of Fed. Rep. of Germany

[73] Assignee: Robert Bosch GmbH, Stuttgart, Fed. Rep. of Germany

[21] Appl. No.: 627,486

[22] Filed: Jul. 6, 1984

Related U.S. Application Data

[63] Continuation of Ser. No. 411,225, Aug. 25, 1982, abandoned.

[30] Foreign Application Priority Data

May 6, 1982 [DE] Fed. Rep. of Germany ..... 3216983

[51] Int. Cl.[3] ..... F02B 3/00

[52] U.S. Cl. ..... 123/492; 123/493

[58] Field of Search ..... 123/492, 493

[56] References Cited

U.S. PATENT DOCUMENTS 4,257,377 3/1981 Kinugawa ..... 123/492

4,363,307 12/1982 Amano ..... 123/492

FOREIGN PATENT DOCUMENTS 55-51679 11/1981 Japan ..... 123/492

*Primary Examiner*—Ronald B. Cox

*Attorney, Agent, or Firm*—Edwin E. Greigg

[57] ABSTRACT

A control device having certain criteria which must be fulfilled in order to trigger an acceleration enrichment. Criteria are a defined number of successive load values of increasing tendency and/or an actual load value with a defined distance above the arithmetic mean of a number of preceding load values. For the acceleration enrichment itself operational parameters, such as rpm, load, load gradient, temperature and number of revolutions since the triggering of the acceleration are processed.

16 Claims, 3 Drawing Figures

CONTROL DEVICE FOR A FUEL METERING SYSTEM OF AN INTERNAL COMBUSTION ENGINE

This is a continuation of copending application Ser. No. 411,225 filed Aug. 25, 1982, now abandoned.

BACKGROUND OF THE INVENTION

The invention is based on a control device for a fuel metering system of an internal combustion engine with a clocked determination of load values and with a computer for the generation of fuel metering signals in dependence from operating parameters. From German Offenlegungsschrift No. 28 40 793 (U.S. Pat. No. 4,275,695) a device for the determination of a fuel injection signal is known. Therein a constant-temperature anemometer serves to determine the througput of air in the intake line of an internal combustion engine with externally supplied ignition. The air throughout values are collected in either time synchronized or angle synchronized intervals, the several values are linearized and are finally further processed in a computer for the purpose of forming an injection signal value.

In view of an always continuing improvement in the composition of the exhaust gases and of the driving comfort with a simultaneous fuel use as small as possible, it has been shown that the known device cannot show best results, especially when it does control.

OBJECT AND SUMMARY OF THE INVENTION

With the control device according to the present invention for a fuel metering system for an internal combustion engine, the fuel metering, even during times of acceleration, can be controlled surely and optimally. This, especially because a strict division between acceleration detection and acceleration enrichment is provided and because a multitude of values influencing the acceleration enrichment can be processed.

The invention will be better understood and further objects and advantages thereof will become more apparent from the ensuing detailed description of preferred embodiments taken in conjunction with the drawings.

BRIEF DESCRIPTION OF THE DRAWINGS

Exemplary embodiments of the present invention are shown in the drawing and are described and explained in more detail in the following.

DESCRIPTION OF THE PREFERRED EMBODIMENTS

The preferred embodiments concern, in the narrower sense, flow diagrams for the computer-controlled processing of data, especially the determination of acceleration processes. Since the use of computers in internal combustion engines has been a part of the state of the art for a long time, it does not appear necessary here to describe such computer systems in their entirety.

Figure 1:
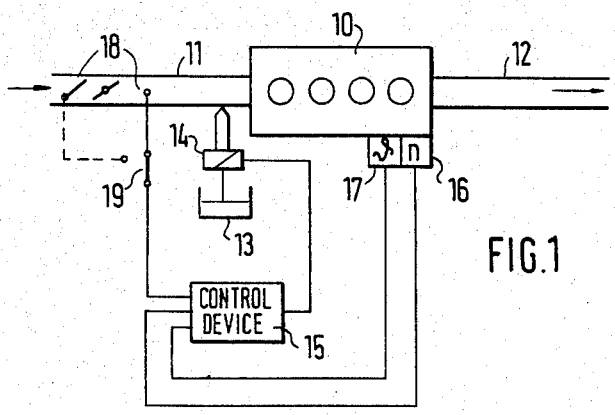
FIG. 1 shows a rough diagrammatical overview of the fuel metering system of an internal combustion engine with external ignition.

FIG. 1 shows a rough diagrammatical overview of an internal combustion engine 1 with intake line 11 and exhaust line 12. The fuel is brought to the intake line 11 from a tank 13 via a pump (not shown) and an electromagnetic injection valve 14. A control device 15 processes signals from sensors for the rpm 16, temperature 17 and load 18, wherein for the load signal pressure values as well as rate of air flow values can be processed, which is depicted by the symbolic showing of a double-throw switch 19. The basic structure of a fuel metering system for an internal combustion engine shown in FIG. 1 has been, by itself, known for a long time. The present invention, however, is concerned especially with the determination of acceleration processes. For this purpose, load values (intake line pressure values or rate of air flow values) at defined crankshaft angles or at time-constant intervals are determined and these values are interrogated as to changes.

Figure 2:
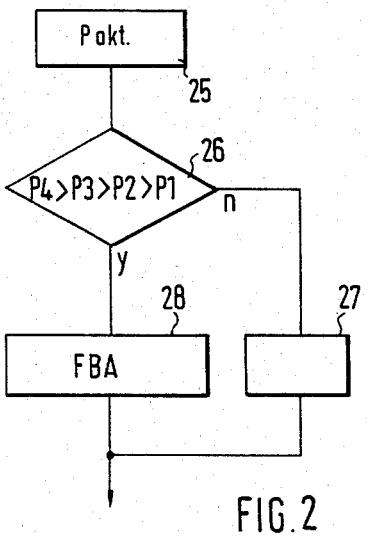
FIG. 2 shows a first embodiment of an acceleration detection and FIG. 3 a second exempiary embodiment also shown as a flow diagram.

In the first exemplary embodiment according to FIG. 2, pressure values are compared in sequence and if four successive pressure values show a rising tendency, an acceleration enrichment is triggered, preferably formed as a factor which depends on operational parameters. The following expression in the form of a formula has proven to be especially useful as a acceleration enrichment factor:

$$FBA = f_1(n) \cdot f_2\left(\frac{dp}{dt}\right) \cdot f_3(\theta) \cdot f_4(Z) \cdot f_5(P_{act})$$

Herein, n means rpm load values, dp/dt the derivation of the pressure in relation to time, $\theta$ the temperature, $P_{act}$ the last measured pressure and Z the number of revolutions since the triggering of the acceleration enrichment.

Because of the fact that four successive pressure values are determned for the triggering of the acceleration, even weak load changes can be surely recognized as acceleration processes.

Figure 3:
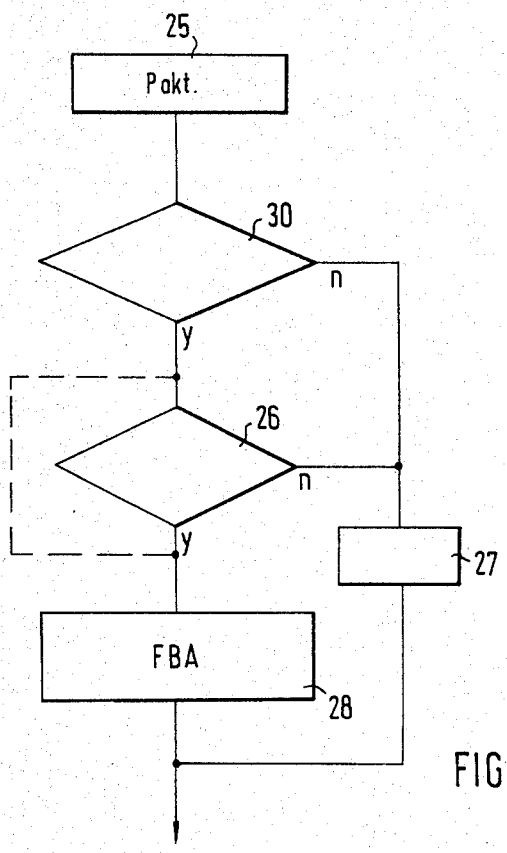

While in the flow diagram in accordance with FIG. 2, after a pressure determination 25 an interrogation as to the successive increase of four successive pressure values p follows and, depending on the result of the interrogation either no acceleration enrichment is triggered (27) or an acceleration enrichment is triggered in accordance with the above formula (28), the object of FIG. 3 shows an additional interrogation unit 30. It is placed between the pressure determination 25 and the interrogation unit 26. The attitude of its output signal is determined by the question, whether an actual pressure value shows a defined distance, dependent on $p_{act}$, from the arithmetic mean of four preceding pressure values. Expressed in a formula, this means.

$$P_{act} - \frac{1}{4}\sum_{i=1}^{4} Pi > \Delta P(P_{act})$$

If the defined load change appears, then it is determined in accordance with the interrogation in block 26, whether the last four pressure values constitute a rising tendency and, if so, the accelertion enrichment is triggered.

In FIG. 3 a solution is shown by broken lines, in which no interrogation as to successive pressure values is made, because in many applications, depending on the motor or vehicle type, good results are achieved without the interrogation unit 26.

Changes can be made to the extent that in place of the input line pressure a signal in regard to the rate of air flow in the input line can be used as a load signal. Furthermore, the number of values to be compared can be adjusted to the conditions obtaining, and finally a number of operational parameters in all posssible variations can be used during the determination of the acceleration enrichment factor proper.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. A control device for a fuel metering system of an internal combustion engine comrising means for sequentially determining load values, n, made successively in time, and a computer for the generation of fuel metering signals dependent on operational parameters, further including means for interrogating at least four successive load values occuring in sequence as to their tendency wherein a sequential rising tendency of said at least four successive load values corresponding to an acceleration triggers an acceleration enrichment.

2. A control device in accordance with claim 1, characterized in that pressure values are used as load values.

3. A control device in accordance with claim 1, characterized in that rate of air flow values are used as load values.

4. A control device in accordance with claim 1, characterized in that $$P_{act} - \frac{1}{n} \sum_{i=1}^{n} Pi > \Delta P\,(P_{act})$$

serves as triggers criterion for the acceleration enrichment, where P is pressure.

5. A control device in accordance with claim 2, characterized in that $$P_{act} - \frac{1}{n} \sum_{i=1}^{n} Pi > \Delta P\,(P_{act})$$

serves as trigger criterion for the acceleration enrichment, where P is pressure.

6. A control device in accordance with claim 3, characterized in that $$P_{act} - \frac{1}{n} \sum_{i=1}^{n} Pi > \Delta P\,(P_{act})$$

serves as trigger criterion for the acceleration enrichment, where P is pressure.

7. A control device in accordance with claim 1, wherein for the formation of the enrichment factor for the acceleration a combination of the values rpm, load, load gradient, temperature and number of revolutions since the triggering of the acceleration is processed.

8. A control device in accordance with claim 1, wherein for the acceleration enrichment a factor of the following formula is formed;

$$FBA = f_1(n) \cdot f_2\left(\frac{dp}{dt}\right) \cdot f_3(\theta) \cdot f_4(Z) \cdot f_5(P),$$

where P is pressure.

9. A control device in accordance with claim 1, characterized in that a clocked determination of load factors is done synchronous with determnation of an angle of the crankshaft.

10. A control device in accordance with claim 9, characterized in that a clocked determination of load factors is done synchronous with the angle according to defined time intervals.

11. A control device in accordance with claim 9, characterized in that for the formation of the enrichment factor for the acceleration a combination of the values rpm, load, load gradient, temperature and number of revolutions since the triggering of the acceleration is processed.

12. A control device in accordance with claim 10, characterized in that for the formation of the enrichment factor for the acceleration a combination of the values rpm, load, load gradient, temperature and number of revolutions since the triggering of the acceleration is processed.

13. A control device in accordance with claim 11, characterized in that for the formation of the enrichment factor for the acceleration a combination of the values rpm, load, load gradient, temperature and number of revolutions since the triggering of the acceleration is processed.

14. A control device in accordance with claim 5, characterized in that a clocked determination of load factors is done synchronous with the determination of an angle of the crankshaft.

15. A control device in accordance with claim 6, characterized in that a clocked determination of load factors is done synchronous with the determination of an angle of the crankshaft.

16. A control device in accordance with claim 5, characterized in that a clocked determination of load factors is done synchronous with the angle is done according to defined time intervals.

* * * * *